United States Patent [19]

Tuckey

[11] Patent Number: 4,995,349

[45] Date of Patent: Feb. 26, 1991

[54] STRATIFIED AIR SCAVENGING IN TWO-STROKE ENGINE

[75] Inventor: Charles H. Tuckey, Cass City, Mich.

[73] Assignee: Walbro Corporation, Cass City, Mich.

[21] Appl. No.: 390,540

[22] Filed: Aug. 7, 1989

Related U.S. Application Data

[63] Continuation-in-part of Ser. No. 153,204, Feb. 8, 1988, abandoned.

[51] Int. Cl.[5] ..... F02B 75/02

[52] U.S. Cl. ..... 123/65 VB; 123/65 WA; 123/73 BA; 123/323; 123/41.68; 123/90.11

[58] Field of Search ..... 123/323, 546, 41.6, 123/41.68, 41.8, 65 VB, 65 WA, 73 B, 73 PP, 306, 430, 90.11, 65 W, 73 A, 73 BA, 193 P

[56] References Cited

U.S. PATENT DOCUMENTS

| | | | |
|---|---|---|---|
| 873,650 | 12/1907 | Anderson | 123/41.68 |
| 990,604 | 4/1911 | Stevens | 123/306 |
| 1,436,574 | 11/1922 | Colt | 123/41.68 |
| 2,252,187 | 8/1941 | Kylen | 123/65 VB |
| 3,751,921 | 8/1973 | Blomberg et al. | 123/323 |
| 3,815,566 | 6/1974 | Staggs | 123/65 VC |
| 3,817,227 | 6/1974 | Onishi | 123/73 A |
| 4,445,468 | 5/1984 | Onishi et al. | 123/73 PP |

FOREIGN PATENT DOCUMENTS

| | | | |
|---|---|---|---|
| 167985 | 9/1950 | Austria | 123/65 WA |
| 2041443 | 9/1980 | United Kingdom | 123/306 |
| 2115485 | 9/1983 | United Kingdom | 123/73 B |

*Primary Examiner*—David A. Okonsky

*Attorney, Agent, or Firm*—Barnes, Kisselle, Raisch, Choate, Whittemore & Hulbert

[57] ABSTRACT

A two-cycle engine has an air inlet in the crankcase, and a spiral air-fuel passage encircling the cylinder wall rising from the crankcase to an inlet in the cylinder head to effect cooling of the cylinder. A fuel injection device introduces fuel into the transfer passage. A unidirectional valve admits air and fuel into the cylinder head and curved fins impart a swirling action to the air and fuel to effect a fuel and air stratification. An exhaust passage in the cylinder wall has an adjustable throttle to control dirctly the outflow of exhaust gases and indirectly the inflow of fresh fuel-air mixture, whereby the power level of the engine is controlled.

4 Claims, 4 Drawing Sheets

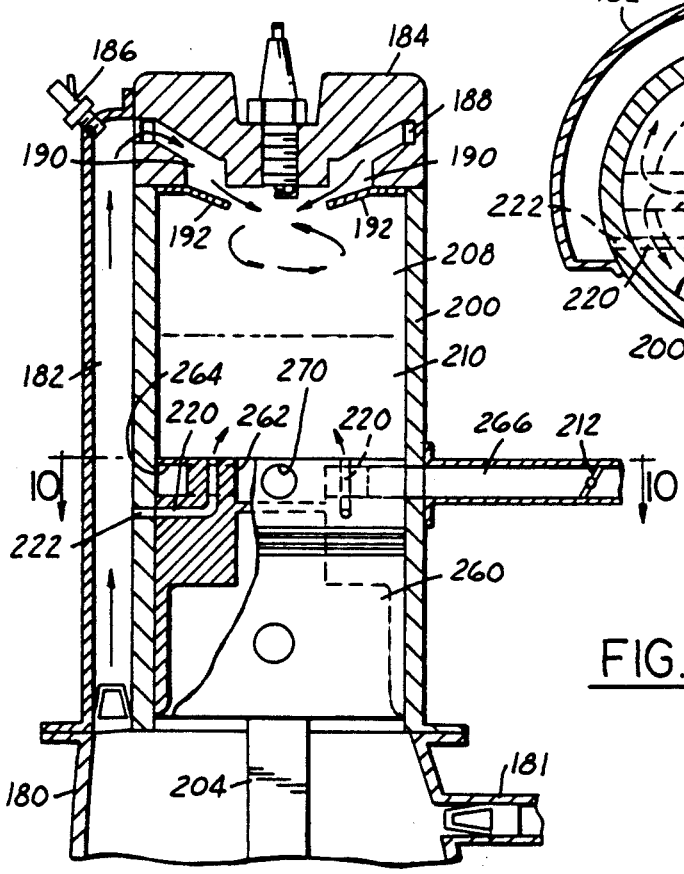
FIG.9
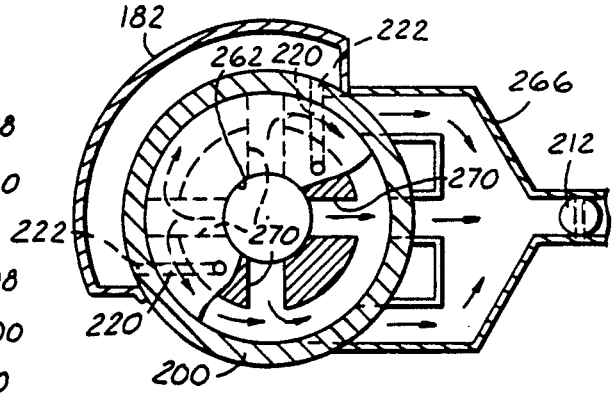
FIG.10
FIG.11
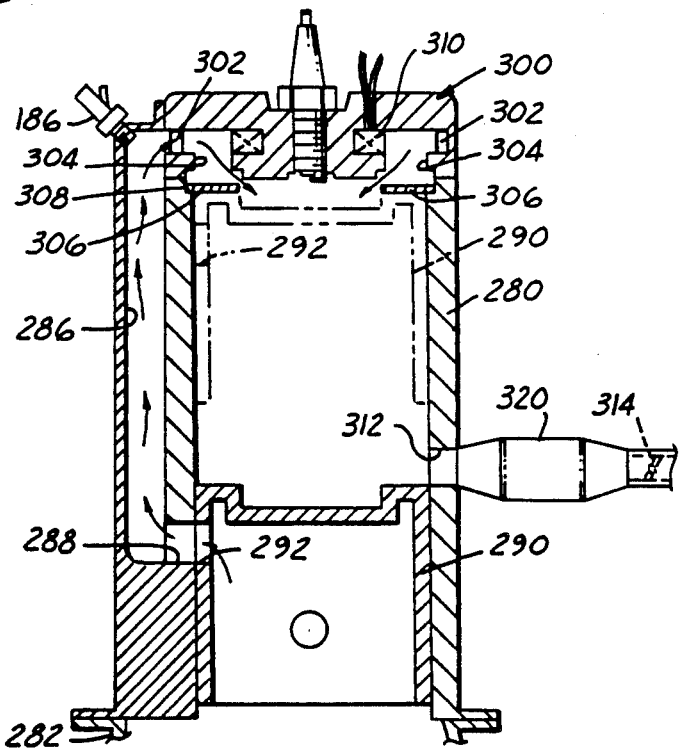

STRATIFIED AIR SCAVENGING IN TWO-STROKE ENGINE

REFERENCE TO RELATED APPLICATION

This application is a continuation-in-part of my co-pending application, Ser. No. 153,204, filed Feb. 8, 1988 and now abandoned.

FIELD OF INVENTION

Two-stroke engine design with throttle control or exhaust gas and stratified air and fuel intake.

BACKGROUND AND OBJECT OF THE INVENTION

In two-cycle internal combustion engines, it has been standard practice to introduce air and fuel into the crankcase of the engine and transfer it to the firing chamber of the cylinder through transfer ports along the side of the cylinder. This transfer takes place as the exhaust gases are exiting the cylinder. Thus, the fuel and air are being forced from the crankcase by the pressure created by the descending piston. Air is throttled into the crankcase which can result in a power loss and a decrease in efficiency.

It is an object of the present invention to provide a two-cycle engine design which embodies a revised cycle of air and fuel intake with a throttle control of exhaust gas as a means to control the power output of the engine.

Reference is made to a publication of the Society of Automotive Engineers, Inc., No. 790,501, presented at Congress and Exposition, Cobo Hall, Detroit, Michigan, U.S.A. Feb. 26-Mar. 2, 1979, entitled "Active Thermo-Atmosphere Combustion-A New Combustion Process for Internal Combustion Engines" by Shigeru Onishi et al.

Reference is also made to Japanese Pat. Preliminary Publications Nos. as follows 54-289816 - Mar. 3, 1979 (application 52-94133, Filed Aug. 8, 1977, Inventor - Shigeru Onishi) and 47-23708 - Oct. 13, 1972 (application 46-13382, Filed Mar. 11, 1971), Inventor - Shigeru Onishi).

The above-referenced material indicates the advantages and explains the combustion process of stratified charges of exhaust gases and fuel and air mixtures including the throttling of exhaust gases.

An object of the present invention is the provision of an air and fuel supply which effects a stratification of exhaust gas, air and fuel-air mixture to enhance the efficiency of the firing and combustion and also a complete engine design which utilizes the stratification and exhaust or scavenge control to provide a highly efficient operation.

A still further object of the engine design is the use of the incoming combustion air to cool the walls of the operating cylinder while imparting to the mixture a swirling action to position the fuel adjacent a spark plug to enhance the firing. In addition, an entrance valve and swirl pattern plate is provided at the cylinder head to further impart a circular motion which stratifies the air and the air and fuel mixture.

Additional features of the invention will be apparent in the following description and claims in which the principles of the invention are set forth together with details to enable persons skilled in the art to practice the invention all in connection with the best mode presently contemplated for the invention.

BRIEF DESCRIPTION OF THE DRAWINGS

DRAWINGS accompany the disclosure on the various views thereof may be briefly described as:

FIG. 9, a sectional view of a modified piston to equalize exhaust scavenging.

FIG. 10, a sectional view on line 10—10 of FIG. 9.

FIG. 11, a sectional view of ring inlet valve with magnetic control.

DETAILED DESCRIPTION OF THE INVENTION AND THE MANNER AND PROCESS OF USING IT

Figure 1:
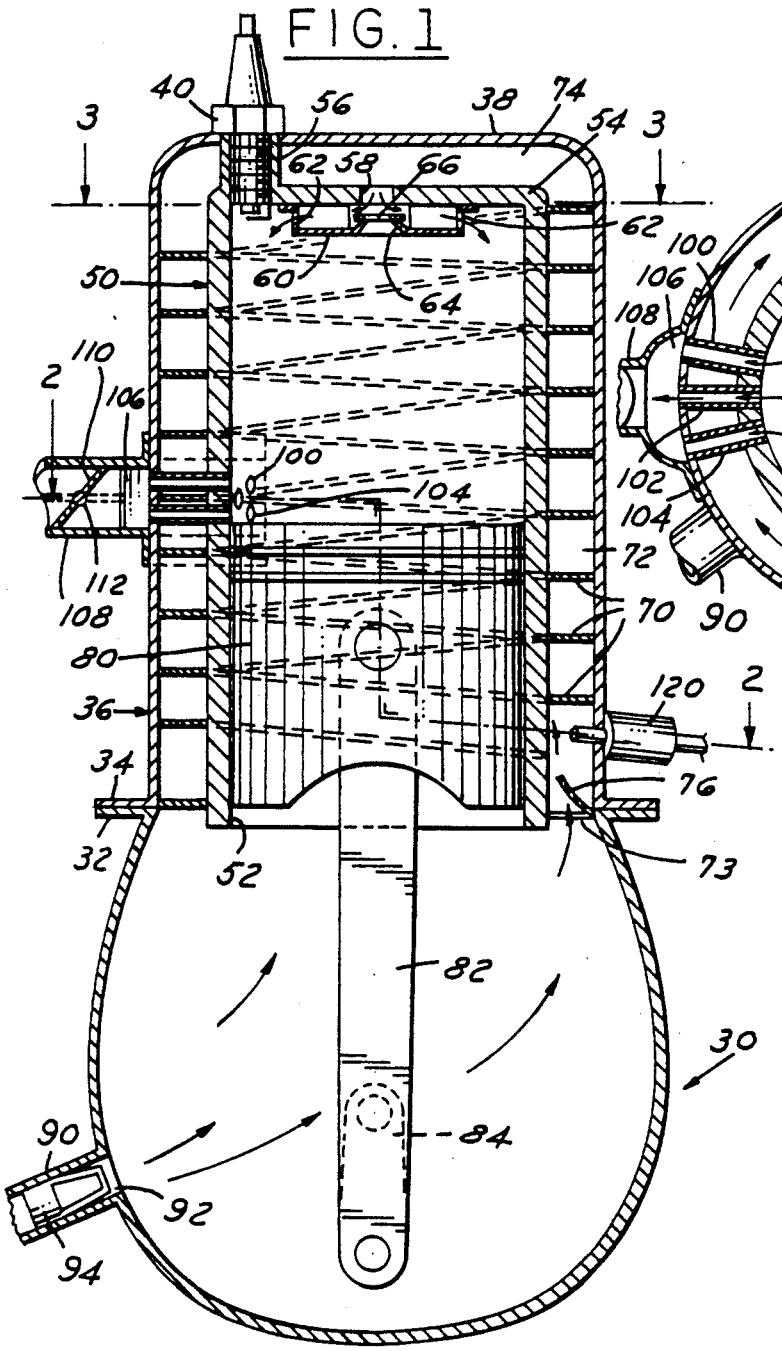
FIG. 1, a vertical section of a diagrammatic illustration of a two-cycle engine illustrating the invention.

With reference to the drawings, FIG. 1 is a diagrammatic illustration of a two-cycle engine in vertical cross-section. A crankcase 30 flanges at 32 supports a flange 34 of a cylinder jacket 36 having a closed top 38 in which is mounted a spark plug 40. An engine cylinder 50 has an open end 52 exposed to the crankcase 30 and a cylinder head 54 at one side of which the spark plug 40 is screwed into a boss 56.

Figure 3:
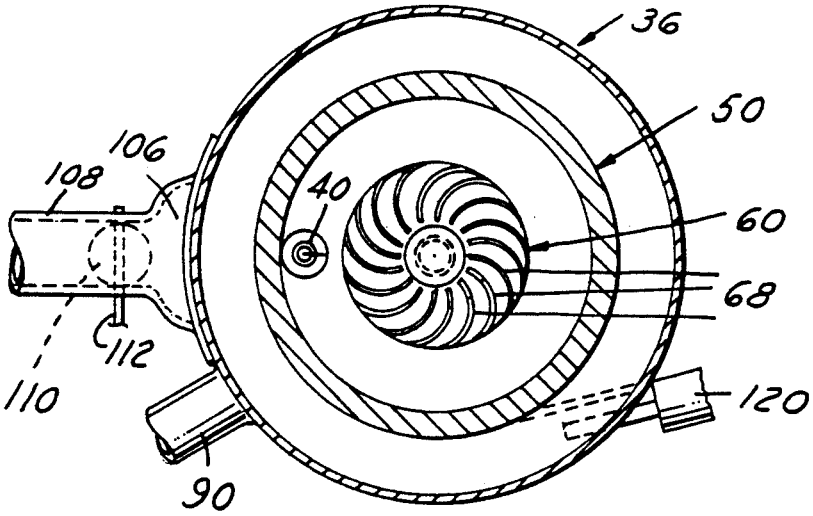
FIG. 3, a sectional view on line 3—3 of FIG. 1.

The cylinder head 54 has a central opening 58 below which is mounted a cage 60 having side openings 62 and a concave central recess 64 opened and closed by a check valve plate 66. The plate 66 is confined for vertical motion to close the opening 58 in the cylinder head in response to pressure within the cylinder 50. Within the cage 60, as shown in FIG. 3, are curved blades 68 which impart a swirling motion to the incoming air and the incoming air and fuel. The cage 60 and the valve plate 66 and fins or blades 68 are made of heat resistant metal which can withstand the heat of the fuel firing during combustion cycles.

In the annular chamber between the jacket 36 and the exterior of the cylinder wall 50 are spiraled baffle turns 70 which form a spiral path 72 from the crankcase at 73 to the chamber 74 above the cylinder head 54. A reed valve 76 is located at the entrance to the spiral passage 72 arranged to pass air from the crankcase to the passage.

The cylinder 50 has a piston 80 slidably mounted in the cylinder 50 with a standard piston rod 82 and crank 84.

An air inlet port tube 90 opens to the crankcase at 92 and a double or quadruple reed valve 94 provides the one-way control on the air inlet.

Figure 2:
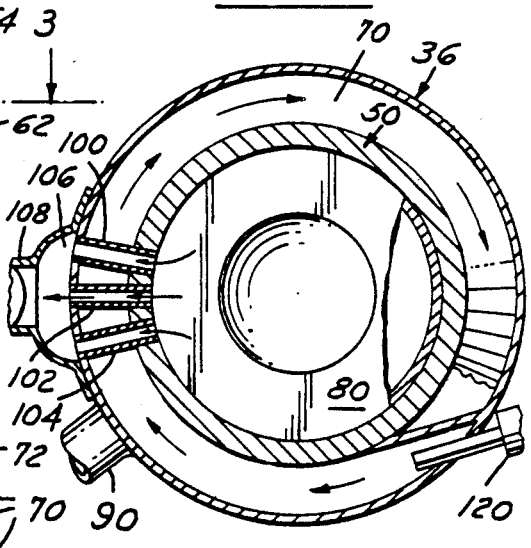
FIG. 2, a sectional view on line 2—2 of FIG. 1.

As illustrated in FIGS. 1 and 2, the cylinder wall 50 is ported at 100, 102 and 104 with short tubes leading to an exhaust chamber 106 which narrows to a throttle passage 108 in which is mounted a throttle plate 110 mounted on a control shaft 112.

Just above the entrance 73 to the spiral passage 72 is a fuel injector 120 which is electronically actuated to inject fuel into the spiral passage. The direction of swirl in the passage 72 imparted by the baffle turns 70 is the same as the direction of swirl which will be imparted by the blades 68 in the cage 60.

THE OPERATION OF THE ENGINE

Cranking the engine will bring the piston 80 up and down in the cylinder 50. Air will enter the crankcase 30 as the piston rises and will move up into: the spiral passage 72 past the reed valve 76 as the piston lowers. This air movement is caused by the lowering of the pressure in the cylinder as the piston moves down and the rise in pressure in the crankcase as the piston moves down. Also, as the piston again descends, fuel is injected into the spiral passage 72 and the combined fuel and air charge is delivered into the combustion chamber. During the up movement of the piston, the charge is compressed. The firing of the spark plug ignites the mixture during the up compression stroke of the piston and the cycle repeats.

As the piston descends during firing, the exhaust ports 100, 102, 104 are opened as the top of the piston passes them and exhaust gases will exit to chamber 106 and passage 108.

As indicated, near the end of the downstroke, the exhaust ports will be exposed, and, depending on the position of the throttle valve, air and air and fuel mixture will enter the cylinder in a measured volume. If the throttle is wide open, the exhaust gases will be mostly expelled by the layer of incoming air. Thus, the swirling charge of incoming air, above which is the air and fuel mixture, serves as a stratified layer essentially in the form of an air piston.

The fuel and air distribution in the cylinder will be stratified in that air from passage 72 will reach the port 58 and enter the cylinder first. As the fuel injector is actuated it will discharge fuel into the air in passage 72. Thus, a mixture of fuel and air will follow the first air charge and will then reach the cylinder. The fins or blades 68 in cage 60 will impart a further swirling action to the air and the fuel and air mixture which is coming from the spiral passage 72. Since the fuel is heavier than air, it will move to the outside centrifugally in the region of the spark plug where it will be ignited. There is then a stratified charge above the piston in the form of air above which is a mixture of air and fuel. The exhaust gases will impart heat to the incoming charge, and, depending on the position of the throttle valve, will be present to some degree in the charge to be compressed upon the up-stroke of the piston.

Figure 4:
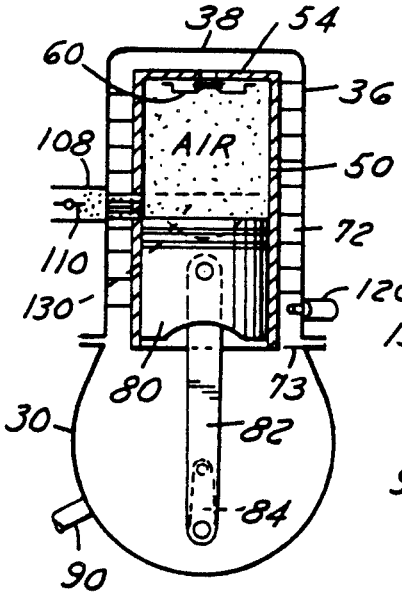
FIGS. 4, 5 and 6, similar views showing varying stages of fuel mixture relative to throttle positions.
Figure 5:
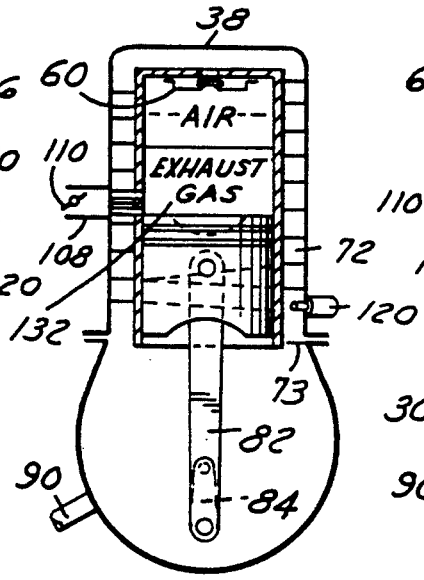
Figure 6:
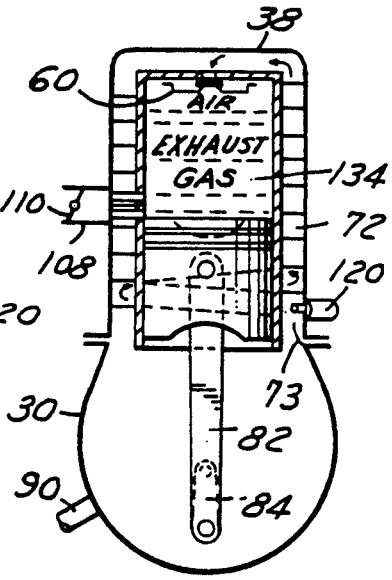

In FIGS. 4, 5 and 6 various stages of a fuel charge are illustrated. In each case, the piston 80 is shown in the down position just prior to the rising compression stroke. In FIG. 4, the throttle is shown in a wide open position. In this circumstance, there is a small residual exhaust gas layer 130 and a large volume of air and fuel which can be stratified as above described into air and a mixture of air and fuel. The exhaust gas is practically completely scavenged. Because of the timing, no fuel escapes into the exhaust passages as is common in the standard two-cycle engine since a charge of air precedes the introduction of fuel Also as described, the air and fuel-air mixture is swirling to insure stratification and complete combustion.

In FIG. 5, when the throttle 110 is partially closed, there is a larger volume of exhaust gas 132 retained above the piston because the partially closed throttle has restricted the escape. Above this residual exhaust gas is the air charge and the fuel-air mixture. There is no restriction by throttling of the incoming air (in contrast to the standard engine), and, accordingly, there is no loss of power due to pumping action of the piston. When the exhaust gas is throttled down, there is a reduced combination charge which results in a lower engine output.

In FIG. 6, the throttle 110 is in closed or idle position which allows some escape of exhaust gases. In this condition, there is a large quantity of exhaust gas 134 in the cylinder and a smaller quantity of air and stratified fuel-air mixture. There is only enough air in the mixture to keep the engine running but still a high concentration of fuel-air mixture at the ignition point. In each case the check valve 66 at the cylinder head closes during the compression phase and ignition phase to insure full power to the piston in the down travel.

In addition to the throttle control at the exhaust, there is added advantage in the system in that the air and fuel-air mixture spirals around the cylinder 50 to cool it by transmission of heat to the passing air but also the air and fuel-air mixture are preheated by passing the cylinder wall to enhance the combustion characteristics. Thus, the spiral passage 72 insures thorough mixing of the fuel and air but also provides a preheat. The swirling action of the spiral passage 72 is increased by the fins in the cage 60 to insure the desired stratification of air and fuel-air entering the cylinder and the movement of the fuel to the outer areas adjacent the spark plug.

The result of the combined action of the various elements described is a more complete combustion, reduction of undesirable exhaust gases, and increased engine efficiency. No external cooling apparatus such as a fan or a coolant pump is required, and also there is no intake air throttling as exists in a standard cycle engine to cause pumping losses in the engine. The engine can operate primarily on auto-ignition except at full throttle when normal spark plug ignition would function. The engine is also adopted to use with fuel mixtures in addition to operation with standard gasoline.

Figure 7:
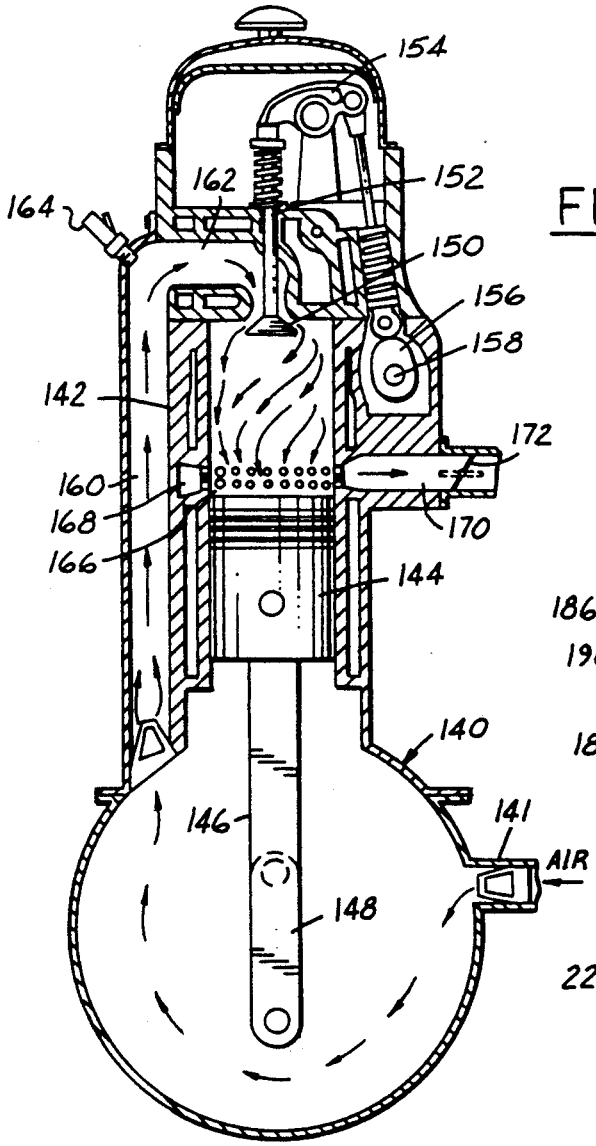
FIG. 7, a sectional view of a two-cycle engine with a valve-in-head and throttled exhaust control.

In FIG. 7, a two-cycle engine is illustrated with a crankcase 140, a reed valve inlet 141, and cylinder 142. A piston 144 with a piston rod 146 and crank 148 as shown in a bottom dead center position. An inlet valve 150 with a stem 152 is controlled by a rocker arm 154 and a cam 156 on cam shaft 158. A transfer passage 160 delivers air from the crankcase to an inlet chamber 162. Fuel can be delivered to the transfer passage by a fuel injector 164. Exhaust gases are scavenged through radial ports 166 in the cylinder wall communicating with an annular passage 168 leading to an exhaust outlet 170 controlled by valve 172.

Thus, the exhaust control of exhaust gases can be used in a standard two-cycle engine with a cam controlled inlet valve.

Figure 8:
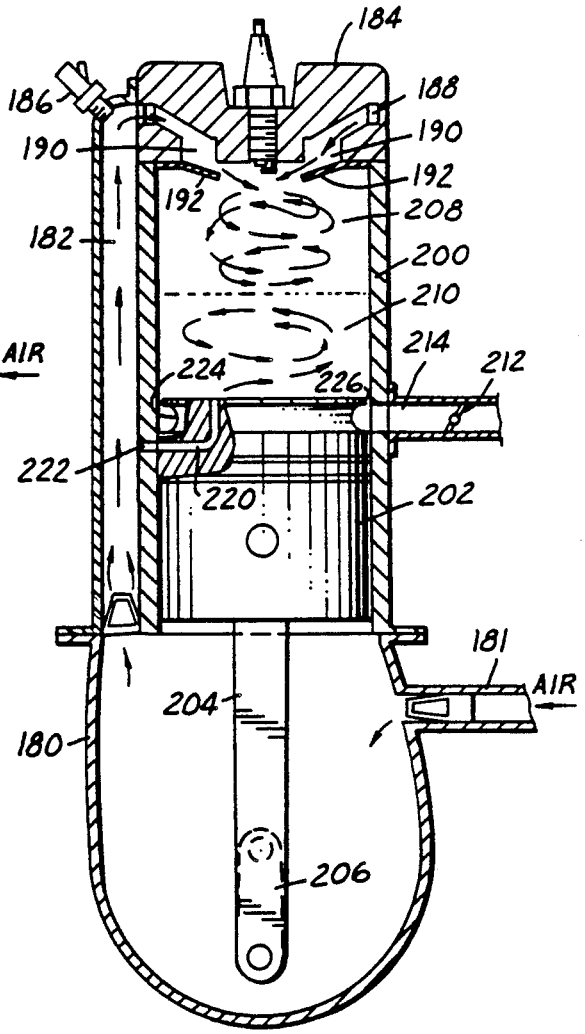
FIG. 8, a sectional view of a two-cycle engine with a modified piston head to facilitate exhaust control.

FIG. 8 illustrates a two-cycle engine with a modified piston head to facilitate exhaust of gases. A crankcase 180 with a reed-valve inlet 181 opens to a transfer passage 182 leading to a cylinder head 184. A fuel injector 186 opens to the passage 182. The cylinder head 184 with a conventional spark plug has an annular passage 188 so that fuel and air can be delivered to the cylinder on an annular pattern A suitable cylinder head valve closure is provided.

The annular fuel and air passage 188 opens to the cylinder through a plurality of ports 190 which are directed in a tangential direction so that the air and fuel enters the cylinder in a swirling action in a similar motion to that described in the embodiment of FIGS. 1 and 3. This assists in the mixing of the fuel and air and also in maintaining the stratification of the fresh charge with the residual hot gases in the cylinder above the piston. The ports 190 can be valved by reed valves 192 or by valves shown in FIG. 1, FIG. 7 or FIG. 11.

A cylinder 200 has a piston 202 with a connecting rod 204 and crank 206. It is to be remembered that the basic concept is the use of stratified fuel and gas combinations which, in connection with the exhaust valve control, provide better combustion and better exhaust characteristics. In FIG. 8, for example, air and fuel are introduced at the top of the cylinder at 208 when the piston 202 is at the low end of the stroke. At the same time exhaust gases are remaining in the lower end of the cylinder 210 in a quantity governed by the exhaust valve 212 in outlet 214.

The piston 202 has an L-shaped passage 220, one leg of which registers with a port 222 in the wall of the cylinder when the piston is at bottom dead center. The other leg of passage 220 opens to he top of the piston so that air can be introduced to the unburned gases of the exhaust at 210.

The piston 202 has an annular groove 224 just below the top surface of the piston. This groove registers with exhaust outlet 214 when the piston is in bottom dead center position and this registration will begin as the piston approaches such a position. The piston head just above the groove 224 is reduced in size at 226 to allow exhaust gases to enter the groove 224. Thus, the scavenged gases will reach the groove 224 and the controlled outlet passage 214 as the piston reaches its low position.

The quantity of hot exhaust gases in the cylinder as the piston rises in the compression stage will depend on the setting of the valve 212. Some combustion supporting air will have reached the exhaust gases through passage 220. Thus, the hot gases stratified with the fresh charge of air and fuel at the top of the cylinder will provide an efficient fuel mixture as the engine operates and the speed of the engine can be readily controlled by the exhaust valve 212. The clearance dimension of the top of the piston should be such that the area of the clearance is essentially equal to the area of the exhaust passage controlled by the exhaust valve.

FIGS. 9 and 10 illustrate a cylinder structure similar to that shown in FIG. 8 and with respect to the cylinder structure identical reference characters are applied to FIG. 9 as in FIG. 8.

The piston 260 in FIG. 9 has L-shaped passages 220 as in FIG. 8 which cooperate with wall ports 222. The top of the piston varies in that a central pocket 262 is provided in the piston and this pocket is encircled by an annular groove 264 which registers with the exhaust chamber 266 shown in top elevation in FIG. 10. Four radial passages 270 connect the top pocket with the surrounding groove 264.

In the operation of the structure shown in FIGS. 9 and 10, as the piston approaches bottom dead center, the hot gases resulting from combustion will flow outward through pocket 262 and passages 270 to the exhaust manifold 266 where the pressured outflow is controlled by a valve 212. As in previous embodiments, the stratification of a swirling charge of air and fuel, introduced at the top of the cylinder, and the hot exhaust gases at the bottom of the charge is maintained. The quantity of exhaust gases dependent on the speed of the engine which is controlled by the exhaust outlet valve 212.

FIG. 11 illustrates a further embodiment of a two-cycle engine with a cylinder 280 on a crankcase 282 and a cylinder head 284 carrying a conventional spark plug. A transfer passage 286 for air is ported at 288 into the cylinder. A diagrammatic showing illustrates a piston 290 with a wall port 292 which registers with port 288 to transfer air from the crankcase to the transfer passage 286 as the piston reaches its lowest position. Thus, the air under pressure in the crankcase is valved into the transfer passage by the skirt port 292 in the piston.

A cylinder head 300 with a conventional spark plug has an annular passage 302 open to the top of the transfer passage 286. Multiple fuel and air inlet ports 304 are controlled by a ring valve 306 which is to be formed of steel or a magnetic material. When in a down position, the ring is retained by a shoulder 308 and the ports 304 are open. In the up position, the ring seats in an annular groove below the ports 304. The pressure from the air transfer passage opens the valve to its down position. The valve is raised to its closed position by an electromagnetic coil 310 which, when energized, causes the valve ring to lift to the closed position. The energization of the coil 310 is done in timed relation to the crank angle or closing of the exhaust port 312 by the rising piston 290.

An exhaust chamber 320 is provided outside the port 312 and ahead of the exhaust throttle 314. This chamber serves as an oxidation chamber with sufficient volume to retain scavenged gases for further oxidation prior to release to atmosphere. At part throttle, there is higher pressure and higher heat retention.

What is claimed is:

1. In a two-cycle engine having a cylinder, a cylinder head having a fuel and air inlet port, a cylinder wall, a piston in said cylinder, a spark plug in said cylinder head, and a crankcase, (a) a unidirectional air inlet into the crankcase, (b) a transfer passage for air from the crankcase to said inlet port in said cylinder head, (c) a unidirectional valve between the crankcase and said transfer passage, allowing flow from the crankcase to said passage, (d) said transfer passage being adapted to carry fuel and air to said cylinder head, (e) a valve positioned in said fuel and air inlet port operable to close during the compression phase of said cylinder, (f) means associated with said inlet port in said cylinder head to impart a swirling motion to air and a fuel-air mixture passing through said inlet port into said cylinder to create a stratification of residual exhaust gases, air, and a fuel-air mixture, (g) an exhaust passage in said cylinder wall, (h) a throttle means in said exhaust passage to control directly the outlet of exhaust gases and indirectly the quantity of air and fuel-air mixture entering the cylinder, and (i) said piston in said cylinder having an annular groove around the circumference directly adjacent the top of the cylinder positioned to register with said exhaust passage when said piston is in the bottom dead center position, the top of the piston at the top of said annular groove having a diameter slightly less than the inner diameter of the cylinder to allow exhaust gases to pass into said groove as the piston descends to the bottom position.

2. In a two-cycle engine having a cylinder, a cylinder head having a fuel and air inlet port, a cylinder wall, a piston in said cylinder, a spark plug in said cylinder head, and a crankcase, (a) a unidirectional air inlet into the crankcase, (b) a transfer passage for air from the crankcase to said inlet port in said cylinder head, (c) a unidirectional valve between the crankcase and said transfer passage, allowing flow from the crankcase to said passage, (d) said transfer passage being adapted to carry fuel and air to said cylinder head, (e) a valve positioned in said fuel and air inlet port operable to close during the compression phase of said cylinder, (f) means associated with said inlet port in said cylinder head to impart a swirling motion to air and a fuel-air mixture passing through said inlet port into said cylinder to create a stratification of residual exhaust gases, air, and a fuel-air mixture, (g) an exhaust passage in said cylinder wall, (h) a throttle means in said exhaust passage to control directly the outlet of exhaust gases and indirectly the quantity of air and fuel-air mixture entering the cylinder, and (i) said fuel and air inlet port comprising an annular opening in the cylinder head communicating with said transfer passage, said annular opening being open at the bottom to said cylinder, a magnetic ring valve surrounding the bottom of said annular opening movable to a closed position to close said opening during the firing of the cylinder, and an electromagnetic coil in the cylinder head concentric with said ring operable to move said ring valve to a closed position in a timing phase prior to the firing of the charged cylinder.

3. In a two-cycle engine having a cylinder, a cylinder head having a fuel and air inlet port, a cylinder wall, a piston in said cylinder, a spark plug in said cylinder head, and a crankcase, (a) a unidirectional air inlet into the crankcase, (b) a transfer passage for air from the crankcase to said inlet port in said cylinder head, (c) a unidirectional valve between the crankcase and said transfer passage, allowing flow from the crankcase to said passage, (d) said transfer passage being adapted to carry fuel and air to said cylinder head, (e) a valve positioned in said fuel and air inlet port operable to close during the compression phase of said cylinder, (f) means associated with said inlet port in said cylinder head to impart a swirling motion to air and a fuel-air mixture passing through said inlet port into said cylinder to create a stratification of residual exhaust gases, air, and a fuel-air mixture, (g) an exhaust passage in said cylinder wall, (h) a throttle means in said exhaust passage to control directly the outlet of exhaust gases and indirectly the quantity of air and fuel-air mixture entering the cylinder, and (i) a supplemental air port in said transfer passage adjacent the top of a piston in bottom dead center position, and one or more passages in the side and top of the piston adjacent the top thereof to transmit air from said transfer passage to the top of the piston to mix with residual combustion exhaust gases above said piston prior to an ensuing compression stroke of the piston, said supplemental port in said piston being closed by the cylinder wall as said piston rises.

4. In a two-cycle engine having a cylinder, a cylinder head having a fuel and air inlet port, a cylinder wall, a piston in said cylinder, a spark plug in said cylinder head, and a crankcase, (a) a unidirectional air inlet into the crankcase, (b) a transfer passage for air from the crankcase to said inlet port in said cylinder head, (c) a unidirectional valve between the crankcase and said transfer passage, allowing flow from the crankcase to said passage, (d) said transfer passage being adapted to carry fuel and air to said cylinder head, (e) a valve positioned in said fuel and air inlet port operable to close during the compression phase of said cylinder, (f) means associated with said inlet port in said cylinder head to impart a swirling motion to air and a fuel-air mixture passing through said inlet port into said cylinder to create a stratification of residual exhaust gases, air, and a fuel-air mixture, (g) an exhaust passage in said cylinder wall, (h) a throttle means in said exhaust passage to control directly the outlet of exhaust gases and indirectly the quantity of air and fuel-air mixture entering the cylinder, and (i) said piston having a top recess depression within the outer circumference having an annular side wall and an annular recess in the outside of said piston surrounding said top recess, said annular recess being positioned to register with said exhaust passage in said cylinder wall when the piston is in a bottom position, and radial passages in the side wall of said top recess depression connecting said top recess and said annular recess to provide exhaust gas exit flow to said controlled exhaust passage.

* * * * *